US005288106A

United States Patent [19]

Dickie et al.

[11] Patent Number: 5,288,106

[45] Date of Patent: Feb. 22, 1994

[54] SAFETY SKI GRIP

[76] Inventors: Robert G. Dickie, 15 Valley Trail, Newmarket, Ontario, Canada, L3Y 4V8; K. Ford Moore, 4 Houdini Way Box 19, R.R. 2, Aurora, Ontario, Canada, L4G 3G8

[21] Appl. No.: 780,981

[22] Filed: Oct. 23, 1991

[51] Int. Cl.[5] ..... A63C 11/22

[52] U.S. Cl. ..... 280/821

[58] Field of Search ..... 280/821, 822

[56] References Cited

U.S. PATENT DOCUMENTS

| | | | |
|---|---|---|---|
| D. 291,909 | 9/1987 | Lajos | D21/230 |
| 3,746,356 | 7/1973 | Shipstad | 280/821 |
| 3,874,686 | 4/1975 | Shipstad et al. | 280/821 |
| 4,232,875 | 11/1980 | Klees | 280/822 |
| 4,440,421 | 4/1984 | Adamson | 280/821 |
| 4,613,156 | 9/1986 | Lajos | 280/821 |
| 4,657,282 | 4/1987 | Koch | 280/821 |

FOREIGN PATENT DOCUMENTS

| | | | |
|---|---|---|---|
| 2357662 | 5/1975 | Fed. Rep. of Germany | 280/821 |
| 3712471 | 7/1988 | Fed. Rep. of Germany | 280/821 |
| 1369228 | 6/1964 | France | 280/821 |

*Primary Examiner*—David M. Mitchell
*Attorney, Agent, or Firm*—Donald E. Hewson

[57] ABSTRACT

A ski pole grip having an integral shell for protecting one's hands during a fall and more specifically for precluding one's thumb from being injured especially from extending outwardly and thereby bearing the brunt of impact during a fall, is disclosed. The shell partially surrounds the grip and is attached to the grip at the top and bottom thereof. The grip and shell are preferably molded in one integral piece with the shell in an inverted position. The shell is folded down to partially surround the grip—it is then in its use configuration and can be inserted onto a ski pole.

3 Claims, 2 Drawing Sheets

SAFETY SKI GRIP

FIELD OF THE INVENTION

This invention relates to ski pole grips and more particularly to ski pole grips adapted to protect one's hands while skiing. More specifically, the devices disclosed herein relate to ski pole grips that preclude injuries to the thumb—such injuries being a very common result of skiing mishaps.

BACKGROUND OF THE INVENTION

Skiing is one of the most popular sports in the world and is participated in both recreationally and competitively by millions of people in many countries throughout the world.

One of the reasons that skiing is so popular is that it is a very physically stimulating and thrilling activity involving high speeds—depending on one's skill level—and also involving many types of movements. Indeed, the essence of skiing is to generally push one's self to do as much as possible and therefore gain as much excitement and enjoyment as possible for one's own skill level.

For example, a beginner will ski down a hill having a shallow decline, which typically has very few bumps or turns, at a fairly low speed and generally without doing anything more than making very shallow turns. While this is not as physically challenging in terms of forces generated as more advanced type of skiing, it is often just as challenging to a beginner as competitive skiing might be to an experienced skier. In essence, what the beginner is doing even at this simple level, is to push his own abilities to the limit and make movements that may cause him to be in a situation that he does not have the skill level to handle, and resultingly the skier will probably fall.

As a beginning skier learns to perform basic maneuvers with confidence, other maneuvers—or similar maneuvers at higher speeds —are attempted. This is done in order to maintain a high level of excitement while skiing. Resultingly, even a more advanced skier is often prone to falling because he is pushing himself to his skill limits by performing new and more difficult maneuvers. Even in the case of advanced or professional skiers, maneuvers are performed that push a skier's skills to the limit. Further, these maneuvers are performed at high speeds. Resultingly, experienced and professional skiers fall occasionally, especially during competitive skiing where one is truly skiing at the limits of one's skill.

In any case, irrespective of the level of ability of a skier, there is a very good chance that any skier will fall at least occasionally. While beginning skiers typically fall more often, and are therefore more frequently exposed to the possibility of injury, more advanced skiers are usually going faster when they fall and therefore may be prone to more severe injury.

Further, skiing is done in an often slippery environment, which makes falling all the more likely.

It has been found that indeed most injuries in skiing are due to falling. Recent statistics indicate that the injury rate is about 3.3 injuries per 1000 skier days. In actuality, it is established that about 40% of downhill skiing injuries go unreported and that the injury rate may even be as high as 10 injuries per 1000 skier days. This translates to possibly as many as 5 million skiing related injuries in the world each year. This statistic has decreased in the last 20 to 30 years partially due to improved equipment such as the skies and boots. Most of the reduction in the injury rate is due to a decrease in lower extremity injuries.

The frequency of upper extremity injuries has not changed significantly, and statistics indicate that slightly under one-half of all skiing injuries are to the upper extremities; and moreover, that 85% of upper extremity injuries are thumb injuries. While at first this may seem slightly unusual, it can be well understood given the nature of how a skier generally tends to fall, and moreover, how a skier generally tends to defend himself when falling. It has been found that most often during a fall a skier will extend his or her arms and hands as a defense against the fall. When a downhill skier falls he typically does not have time to let go of the poles, or even if he does relax his grip on the poles, the poles generally remain within his hands. As the skier gets closer to the ground during the fall, the basket end of the poles usually trails behind which manages to tilt the hand in the forward direction of the thumb. As the skier outstretches his hands to help break the fall, the grip portion of the pole of the ski acts to isolate the thumb from the rest of the fingers which helps leave the thumb exposed and therefore vulnerable to impacting the snow.

Unfortunately, due to the direction of travel of the skier and the specific orientation of one's thumb when one's arms and hand are extended forwardly, the thumb is not designed to bend in the direction of the forces experienced on impact with the snow. In order words, most people's thumbs cannot bend back enough to absorb the impact of the forces experienced. Injury can therefore easily occur when the hands and arms hit the snow, especially at high speeds. Typically, a strong valgus force (bending back) occurs on the thumb, which strains the ulnar colateral ligament. Occasionally there is even a fracture at the base of the first phalanx joint of the thumb.

It has been found that it is very common to have one's thumbs protruding in an extended position, rather than somewhat covered in a closed position. Very commonly —as indicated by the 85% thumb injury rate—thumb impacts directly in the snow. Such injuries are apparently more common if the skier is still holding onto the ski pole. It is generally assumed that the ski pole is in some way responsible for the high frequency of thumb injuries in skiing, since other forms of sport where forward falls are common do not have a high frequency of thumb injuries.

A device that could preclude one's thumb from protruding outwardly while holding a ski pole grip and also that would protect one's thumb from direct impact with snow during a fall could potentially help a skier avoid—or at least lessen the risk of—thumb injuries while skiing.

DESCRIPTION OF THE PRIOR ART

Basic ski poles have a grip at the top end thereof that has a serpentine shaped grip at the forward edge in order to accommodate a skier's fingers. Further, this type of grip is typically slightly convex at its rear edge in order to more comfortably fit into the palm of a hand that is gripping it.

This type of ski pole grip may also have a broad plate on the top, with the plate being generally perpendicular to the axis of the ski pole. In some studies, it has been found that skiers using a pole with this type of grip are even more likely to sustain thumb injuries as a result of a fall.

Another type of prior art ski pole grip is generally referred to as a flared ski pole handle. These handles have a flare or thumb gutter which, when a person is falling, block the normal tendency for interphalangeal flexion—thereby causing the tip of the thumb to be the point of initial impact. Studies have found that flared ski pole handles have a potential for being a major etiologic factor in some injuries in skiers.

Very often, each of these types of ski pole grips has attached to it and for use in conjunction with it a strap that is used to keep the pole attached to the skier if the skier releases his grip on the pole. Typically, the hand is put through the strap either from above or below before gripping the ski pole grip, and the strap is generally positioned around the wrist.

SUMMARY OF THE INVENTION

The present invention provides a protective ski grip that helps protect one's hands while skiing, and especially protects one's hands—and most specifically one's thumb—from being injured during a fall while skiing. The present invention provides a protective shell for use in conjunction with a ski pole grip. The protective shell and the grip may be one integral piece or the shell and grip may be two separate pieces firmly attached one to the other. The shell generally surrounds the grip and shield the grip at its front, both sides, top and bottom. The most important feature of the protective shell is that it precludes the thumb from projecting outwardly while gripping the ski pole grip and further protects the thumb from receiving a direct impact if a skier should fall. The protective shell therefore precludes the thumb being injured during a fall.

The protective shell also protects the fingers and knuckles from receiving direct impact during a fall, protects against cuts to gloves and hands, and also helps preclude frostbite of the fingers and thumb by acting as a wind shield.

The device of the present invention is molded in a one piece configuration with the shell being formed in an inverted manner and located above the grip. The shell must be carefully folded down around the grip such that it is no longer inverted. There are four slots, two in the first attachment portion and two in the second attachment portion to allow the shell to fold easily to its non-inverted in use configuration.

In general, the present invention provides a safety device for providing protection for a person's thumb and fingers while holding a ski pole grip. The device comprises grip suitable for being grasped by a person's hand; and a protective shell having a first side shield portion, a second side shield portion, a front shield portion, and first and second attachment portions. The shell partially surrounds the grip with the first side shield portion being positioned over the thumb area of said grip—being the area of the grip where the thumb of the hand holding the grip will be found; and the second side shield portion positioned over the knuckle area of said grip—being the area of said grip where the first and second knuckles of the fingers of the hand holding the grip will be found. The front shield portion spans between the first and second side shield portions.

The first side shield portion has a front portion that is disposed forwardly of said grip when the device is in place and the ski pole grip is in proper position in the user's hand. Moreover, a middle portion thereof is provided, for precluding the thumb of the hand from extending substantially outwardly from the grip. The first and second attachment portions are for attaching the shell to the grip near the top and bottom thereof, respectively; and also they serve the purpose of horizontally spacing the first side shield portion, the second side shield portion, and the front shield portion, from the grip.

BRIEF DESCRIPTION OF THE DRAWINGS

Embodiments of this invention will now be described by way of example in association with the accompanying drawings in which.

DETAILED DESCRIPTION OF THE PREFERRED EMBODIMENTS

Figure 1:
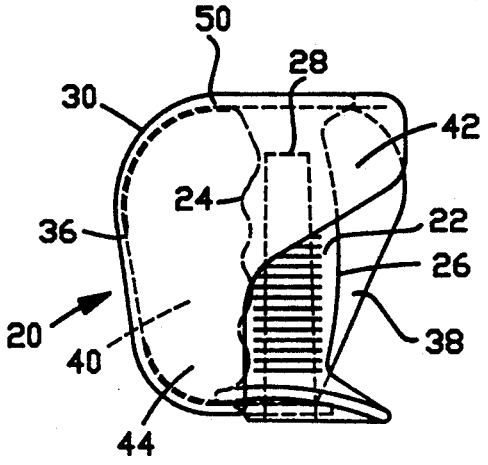
FIG. 1 is a side view of the present invention when in its in use configuration.
Figure 2:
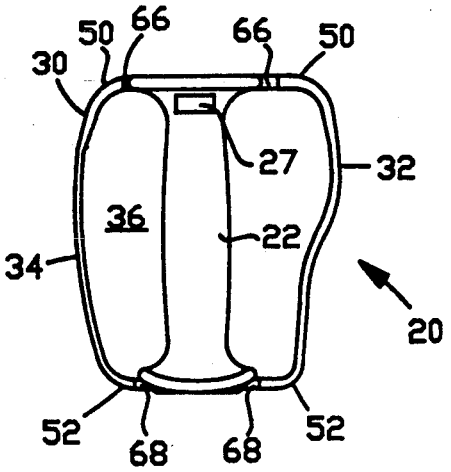
FIG. 2 is a rear view of the present invention as shown in FIG. 1.
Figure 3:
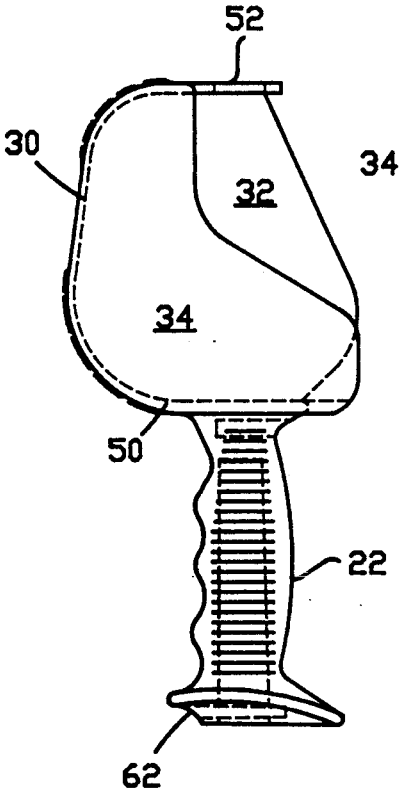
FIG. 3 is a side view similar to FIG. 1 with the present invention in its molded configuration.
Figure 4:
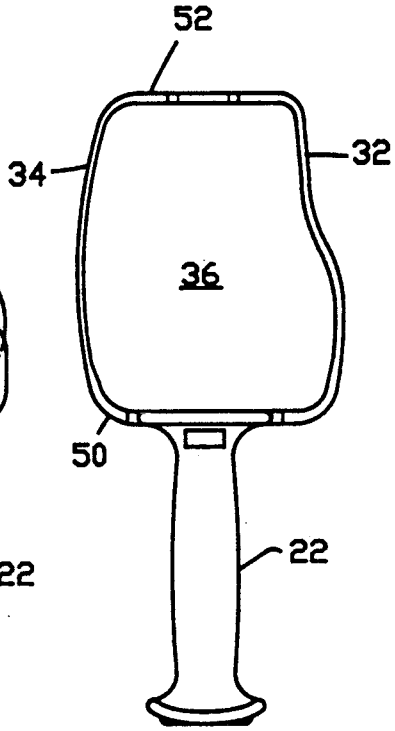
FIG. 4 is a rear view of the present invention as shown in FIG. 3.
Figure 5:
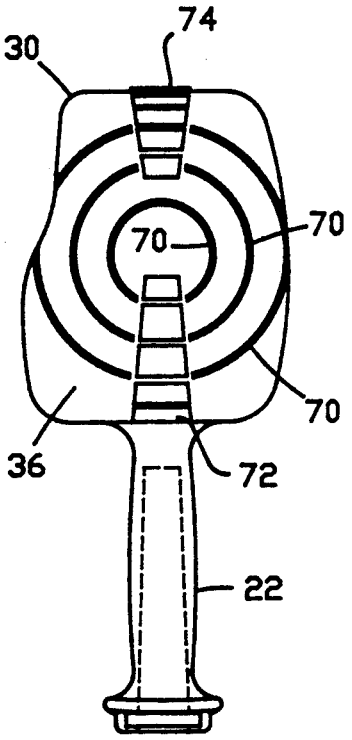
FIG. 5 is a front view of the present invention as shown in FIG. 3.
Figure 6:
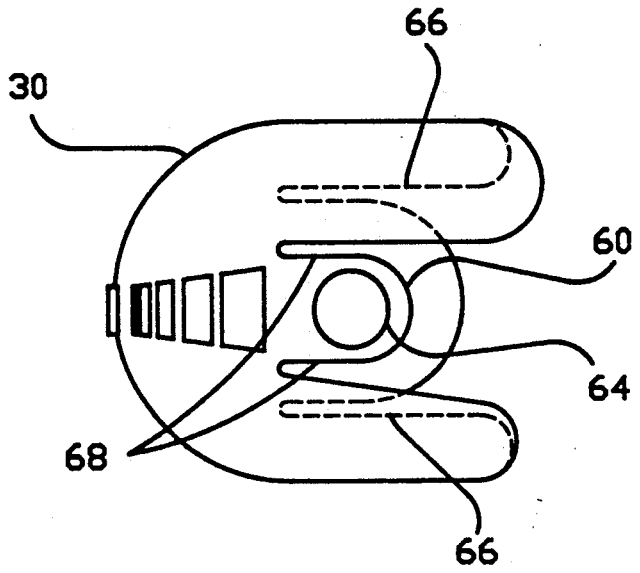
FIG. 6 is a top view of the present invention as shown in FIG. 3.

Reference will now be made to FIGS. 1 and 2 which show the ski grip protector 20 in its in use configuration. There is a grip 22 centrally located within the protector 20. The grip 22 has a serpentine shaped front surface 24 for accommodating a skiers fingers and a slightly convexed rear surface 26 for accommodating one's palm. There is also a flared base 27 at the bottom of the grip 22 that helps to preclude one's hand from sliding downwardly off the grip 22. There is also an elongated cylindrical recess 28 centrally located within the grip 22 for receiving and retaining the top of a ski pole. Typically, the ski pole would be frictionally engaged within the recess 28 of the grip 22. There is also an orifice 29 near the top rear of the grip 22 that is adapted to receive a strap (not shown).

Generally surrounding the grip 22 is a protective shell 30. Preferably, the grip 22 and the shell 30 are molded as one unitary structure. The protective shell 30 includes a first side shield portion 32 and a second side shield portion 34, and a front shield portion 36 that joins the first side shield portion 32 and the second side shield portion 34. The first side shield portion 32 has a middle portion 40 which is generally located over the thumb and precludes the thumb from extending substantially outwardly from the grip. This is important because many thumb injuries occur as a result of the thumb being extended outwardly from one side of the grip and impacting the snow when a skier falls. The first side shield portion 32 also has a front portion 40 that extends forwardly of the grip 22. This front portion 38 serves to space the front shield portion 36 from the front surface 24 of the grip 22 and also ensures that there is a part of the first side shield portion 32 that is generally ahead of the thumb in order to help absorb any impact forces from the front area. Further, it protects the skier's hand from frost bite.

The second side shield portion 34 also has a middle portion 42 for protecting one's knuckles and fingers and also has a front portion 44 for protecting one's fingers.

It can be seen that the middle portion 42 of the second side shield portion 34 is partially cut away—as compared to the middle portion 38 of the first side shield portion 32—so as to leave the lower portion of the grip 22 somewhat exposed. This is to allow the carpo area of the hand to enjoy some freedom of movement as the hand maneuvers the ski pole.

As can best be seen in FIG. 2, the first side shield portion 32 is very shallowly S-shaped in cross-section with the distance between the first side shield portion 32 and the grip 22 being greater at the top of the ski grip protector 20 than at the bottom. This allows for a little bit of extra room to accommodate the end of a skier's thumb.

The shell 30 is attached to the grip 22 by a first attachment portion 50 at the top of the ski grip protector 20 and also by a second attachment portion 52 at the bottom of the ski grip protector 20. The first attachment portion 50 is preferably an integral part of the shell 30 and also forms as an integral part at the top of the hand grip 22.

FIGS. 3 through 6 show the ski grip protector 20 in its production form. For ease of molding, the ski grip protector 20 is molded in the configuration as shown. It can be seen that the shell 30 is inverted in two senses when compared to the in use configuration as shown in FIGS. 1 and 2. Firstly, the shell 30 is upside down and secondly it is inside out.

In order to transform the shell 30 from its inverted condition when molded to its in use configuration, it must be folded forwardly and downwardly so that it inverts to being right side out and also so that the second attachment portion is brought to the bottom of the grip 22.

In order to retain the second attachment portion 52 at the bottom of the grip 22 a tab 60, which is an integral part of the second attachment portion 52, is introduced into a slot 62 in the base 27. The tab 60 is retained therein by a ski pole (not shown) that is inserted through a circular hole 64 in the tab 60 as the ski pole (not shown) is introduced into the opening 28 in the grip 22.

There is a first pair of slots 66 in the first attachment portion 50 and a second pair of slots 68 in the second attachment portion 52. The first and second pairs of slots are for aiding in folding the shell 30 from its inverted position when molded to its in use configuration.

The front shield portion 36 has a plurality of circularly shaped reinforcing ribs 70 for helping to provide some overall stiffness to the front shield portion 36. There is also a first articulated rib 72 and a second articulated rib 74. The first articulated rib 72 is centrally located in a side to side sense on a shell 30 and spans a bottom portion of the front shield portion 36 and a front portion of the first attachment portion 50. The second articulated rib 74 is also centrally located in a side to side sense on the front shield portion 36 and spans the bottom portion of the front shield portion 36 and the front portion of the second attachment portion 52. The first and second articulated ribs 72, 74 help add to the stiffness of the shell 30 and help keep the front shield portion 36 in place in the event of impact.

Figure 7:
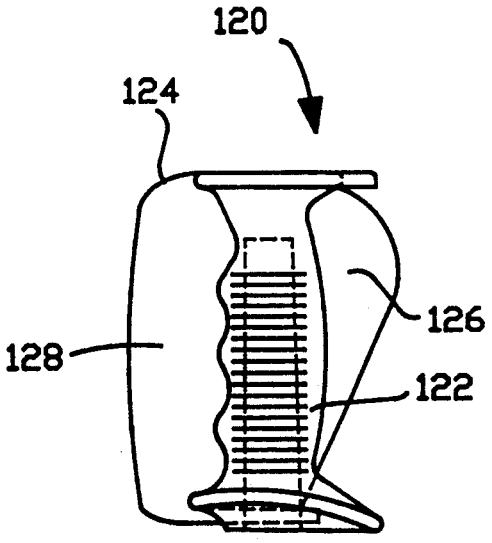
FIG. 7 is a side view of an alternative embodiment of the present invention.
Figure 8:
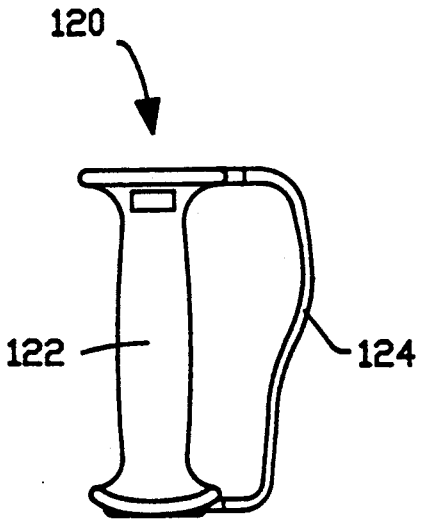
FIG. 8 is a rear view of the alternative embodiment shown in FIG. 7.

Reference will now be made to FIGS. 7 and 8 which show an alternative embodiment of the ski grip protector 120 having a grip 122 and a first side shield portion 124. The first side shield portion 124 has a middle portion 126 and a front portion 128. The first side shield portion 124 precludes the thumb from extending outwardly and also protects the thumb in case of impact.

It should be noted that, in general, the present invention comprises several alternative embodiments as to its mode of presentation. They include the molded shell and grip that are produced as a unitary molding, as discussed above; but the safety device of the present invention, particularly the protective shell, may be presented quite independently of the grip and be provided with means to attach it to grips already in use by a skier, or to grips provided by others. Finally, the presence of the ski pole, so as to retain the tab 60 in place, is not prerequisite otherwise to the functioning of the safety device of the present invention.

Other modifications and alternations may be used in the design and manufacture of the safety ski grip of the present invention without departing from the spirit and scope of the accompanying claims.

What is claimed is:

1. A protective device for protecting a user's hand when used in combination with a ski pole, comprising:

a grip suitable for being grasped by a person's hand, said grip having a slot therein located at the lower end thereof and having a recess therein for receiving a ski pole therein;

a protective shell having a first side shield portion, a second side shield portion, a front shield portion, a first attachment portion and a second attachment portion;

wherein said shell partially surrounds said grip with said first side shield portion being positioned over the thumb area of said grip, being the area of said grip where the thumb of the hand holding the grip will be found; with said second side shield portion positioned over the knuckle area of said grip, being the area of said grip where the first and second knuckles of the fingers of the hand holding the grip will be found; and with said front shield portion spanning between said first and second side shield portions;

said first side shield portion having a front portion that is disposed forwardly of said grip when said device is in place and said grip is in proper position in a person's hand, and further having a middle portion for precluding the thumb of the hand from extending substantially outwardly from said grip;

wherein said first and second attachment portions are for attaching said shell to said grip, and also for positioning said first side shield portion, said second side shield portion, and said front shield portion horizontally from said grip when in place, such that said thumb and fingers easily fit between said shell and said grip;

wherein said second attachment portion includes a tab adapted to fit into said slot and further having an opening therein adapted to receive a ski pole therethrough when said ski pole is in said recess;

wherein, when installed in an in-use position on said ski pole, said tab is located in said slot, said ski pole is in place in said grip and extends through said opening in said tab, whereby said tab is securely retained against movement in three dimensions within said slot.

2. The protective device of claim 1, wherein said protective shell and said grip are one unitary structure.

3. The protective device of claim 1, wherein said device is in combination with a ski pole.

* * * * *